US007812237B1

(12) United States Patent
Dunnett

(10) Patent No.: US 7,812,237 B1
(45) Date of Patent: Oct. 12, 2010

(54) PERCUSSION INSTRUMENT BEATER METHOD AND APPARATUS

(76) Inventor: Ronn Dunnett, 4587 57th St., Delta, BC (CA) V4K-3E4

( * ) Notice: Subject to any disclaimer, the term of this patent is extended or adjusted under 35 U.S.C. 154(b) by 0 days.

(21) Appl. No.: 12/400,719

(22) Filed: Mar. 9, 2009

Related U.S. Application Data

(60) Provisional application No. 61/034,495, filed on Mar. 7, 2008.

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 5,388,494 A 2/1995 Hoshino
5,477,768 A 12/1995 Swift
6,211,448 B1 4/2001 Shigenaga et al.
6,392,130 B1 5/2002 Carlson

FOREIGN PATENT DOCUMENTS

JP 408146945 A * 6/1996 ..... 84/422.1

* cited by examiner

*Primary Examiner*—Kimberly R Lockett
(74) *Attorney, Agent, or Firm*—Dwayne E. Rogge; Hughes Law Firm, PLLC

(57) ABSTRACT

A percussion instrument beater method and apparatus having a mallet which is rotatably coupled to a foot pedal through a ball joint, wherein the ball joint allows substantial positioning about the center or origin of the ball joint. Further disclosed, the ball joint has a through hole which allows slidable adjustment of the mallet shaft relative to the ball joint to allow for lengthening of the mallet from the head to the ball joint.

20 Claims, 11 Drawing Sheets

PERCUSSION INSTRUMENT BEATER METHOD AND APPARATUS

RELATED APPLICATIONS

This application claims priority benefit of U.S. Ser. No. 61/034,495, filed Mar. 7, 2008 incorporated herein by reference.

BACKGROUND OF THE DISCLOSURE a) Field of the Disclosure

This disclosure relates generally to drumming apparatuses, and more particularly to a beater adjustment assembly which may be operated by a user's foot wherein the adjustment assembly comprises a ball joint which allows the user to adjust the angle of the beater shaft relative to the axis of rotation.

b) Background Art

Beater assemblies, which are utilized by a drummer's foot to pivot a mallet about an axis to impact a drum, are well known in the art. One such assembly includes U.S. Pat. No. 704,308 which was patented Jul. 8, 1902. As with most of these assemblies, the beater rotates about a shaft and impacts the face of the drum or a cymbal. These assemblies generally comprise a pedal which is contacted by the user's foot, and some sort of a motion translation assembly which translates the vertical motion of one's foot on the pedal to rotation of the mallet about an axis.

A great many improvements over this basic assembly have been conceived, including U.S. Pat. No. 5,431,081, which includes a chain which connects the foot pedal to the axis of rotation. In some embodiments, a cam-like member can be utilized to adjust the relative motion of the pedal to the swing of a mallet to a desired orientation, such as to create a large amount of leverage for the initial motion of the mallet, and then a shorter lever arm which increases the speed of the mallet once the mallet has initially begun to turn or pivot.

It has also been conceived to slide a ball along a drum stick to provide an enhanced performance. U.S. Pat. No. 5,477,768 discloses such an assembly, which is utilized to convert a drum stick to a mallet-type assembly. Obviously there is no discourse of utilizing the rotational capabilities of such a joint in interoperation with other mechanical devices.

U.S. Pat. No. 6,211,488 discloses a novel method for coupling a plurality of drums in a desired and fixed orientation. FIG. 6 of this patent clearly shows the use of a ball joint to connect the bass drum (2) to a tomtom drum (4). Also shown in FIG. 4 is a highly schematic view of the beater assembly operated by a foot pedal (59). It is clear however that once tensioned, the assembly is configured in FIG. 6 to prohibit movement of the drums (two and four) relative to one another.

SUMMARY OF THE DISCLOSURE

Disclosed herein is a ball joint adjustment assembly for a drum mallet. In one form the assembly has a bass drum pedal axle operatively configured to rotate about a pedal drive axis. The assembly further comprising a substantially spherical ball joint socket coupled to the bass drum pedal axle and operatively configured to rotate therewith. The ball joint socket in one form comprises a hinge side and a split side to allow the socket to clamp around the ball of the ball joint socket. The assembly in one form further comprises a pressure mechanism which may be coupled to the ball joint socket and may be operatively configured to adjust an inner diameter of the ball joint socket. The assembly may further comprise a ball joint ball having an outer spherical diameter substantially the same as the inner diameter of each side of the ball joint socket and further comprise a drum mallet coupled to the ball joint ball and extending therefrom. Arranged in this way, the angle of the drum mallet can be adjusted about the center of the ball joint while the pressure mechanism is in the released state and may be furthermore substantially affixed in place when the pressure mechanism is in a tensioned state.

In one form, the mallet adjustment assembly comprises a mallet shaft which passes through the ball joint ball; and slidably engages the ball joint ball while the pressure mechanism is in the released state. The mallet shaft may also be substantially fixedly coupled to the ball joint ball when the pressure mechanism is in the tensioned state. To facilitate this adjustment, in one form the pressure mechanism is a wing nut. In one form, the hinge side of the ball joint socket further comprises a pivot such that the socket may be opened or closed to allow for release and clamping of the ball, and so the ball portion may be removed or replaced.

The mallet adjustment assembly can also have a post which extends between and thus connects the bass drum pedal axle and the ball joint socket. The bass drum pedal axle may also be coupled to a bass drum pedal which may be operatively configured such that sufficient pressure upon the footplate will cause the bass drum pedal axle to rotate.

In one embodiment, the mallet adjustment assembly further comprises a collar which may be operatively configured to engage the outer surface of the drum pedal axle. This collar ring may be operatively configured to engage the outer surface of the collar and be selectively and rotatably positioned therewith to fix the position of the collar ring relative to the collar. Furthermore, the collar ring may be coupled to the ball joint socket.

Also described herein is a method for adjusting a drum mallet coupled to a footplate. In one form, the method includes the steps of grasping the mallet with a first hand and grasping a pressure mechanism with a second hand. Once the pressure mechanism is released, the mallet is free to rotate about the center of the ball joint socket which may be mechanically coupled to the footplate. This release of the pressure mechanism allows rotating the mallet about the center of the ball joint socket to the desired orientation; and tensioning the pressure mechanism to hold the mallet in place in reference to the ball joint socket.

The method for adjusting the drum mallet may further comprise the step of releasing a pressure mechanism and sliding the mallet shaft through the ball joint ball to adjust the distance between the mallet head and the ball joint to the desired distance. In one form, the step of releasing the pressure mechanism involves only a single movement of a single fastener. The adjusting method may also comprise the step of adjusting a collar ring assembly operatively configured to engage an outer surface of a collar operating as the pressure mechanism, wherein the collar ring is a separate mechanism from the ball joint socket. As recited in one form the ball joint socket allows adjustment of the mallet in multiple planes about the origin of the ball joint socket.

Also disclosed herein is a ball joint adjustment assembly for a drum mallet comprising in one form, a bass drum pedal axle operatively configured to rotate about a pedal drive axis coupled to a ball joint socket comprising a first clamping portion and a second clamping portion. In one form, the first clamping portion is rigidly attached to the second clamping portion at a clamping hinge. A pressure mechanism is also disclosed which is operatively configured to adjust the inner diameter of the ball joint socket. The assembly in one form further comprising a ball joint ball with an outer diameter substantially the same as the inner diameter of the ball joint socket when the pressure mechanism is in the released state. The assembly also including in one form, a mallet, comprising a mallet shaft, which is coupled to the ball joint.

The mallet adjustment assembly is also disclosed wherein the ball joint ball comprises a through hole having an inner diameter substantially the same as the outer diameter of the mallet shaft when the pressure mechanism is in the released state. In one form, the inner diameter of the through hole in one form is operatively configured to be adjusted such that the inner diameter of the through hole is adjustable to impart frictional resistance against the outer diameter of the mallet shaft when the pressure mechanism is in the tensioned state.

To increase the adjustment range of the assembly in one form, a collar is disclosed which is operatively configured to engage the outer surface of the drum pedal axle. A collar ring operatively configured to engage the outer surface of the collar and be selectively and rotatably positioned therewith. In one form, the collar ring comprises a tensioning member which is operatively configured to fix the position of the collar ring relative to the collar, and the collar ring is coupled to the ball joint socket.

Also disclosed herein is an adjustment assembly for a drum mallet comprising a bass drum pedal axle operatively configured to rotate about a pedal drive axis including a ball joint socket coupled to the bass drum pedal axle and operatively configured to rotate therewith. To accomplish this adjustment, the ball joint has an outer spherical diameter substantially the same as the inner diameter of the ball joint socket. In one form, the ball joint includes a set screw which is operatively configured to engage the outer surface of the ball joint to adjust the force required to reposition the ball joint in reference to the ball joint socket. In one form, the drum mallet is coupled to the ball joint and extends therefrom. Arranged in this way, the angle of the drum mallet can be adjusted about the center of the ball joint while the pressure mechanism is in the released state and is furthermore affixed in place when the pressure mechanism is in the tensioned state.

The drum mallet may also comprise a mallet shaft, which passes through the ball joint ball, wherein the mallet shaft slidably engages the ball joint. The adjustment may further comprise a post extending between the base drum pedal axle and the ball joint socket.

In one form, the set screw previously described threadedly engages the socket portion of the ball joint. The set screw in one form has a head portion operatively configured to engage a drum key.

The mallet adjustment assembly may further comprise a collar, which is operatively configured to engage the outer surface of the drum pedal axle. The collar may include a collar ring, operatively configured to engage the outer surface of the collar and be selectively and rotatably positioned therewith. The collar ring may comprise a tensioning member, which is operatively configured to fix the position of the collar ring relative to the collar; wherein the collar ring is coupled to the ball joint socket.

DESCRIPTION OF THE PREFERRED EMBODIMENTS

Figure 1A:
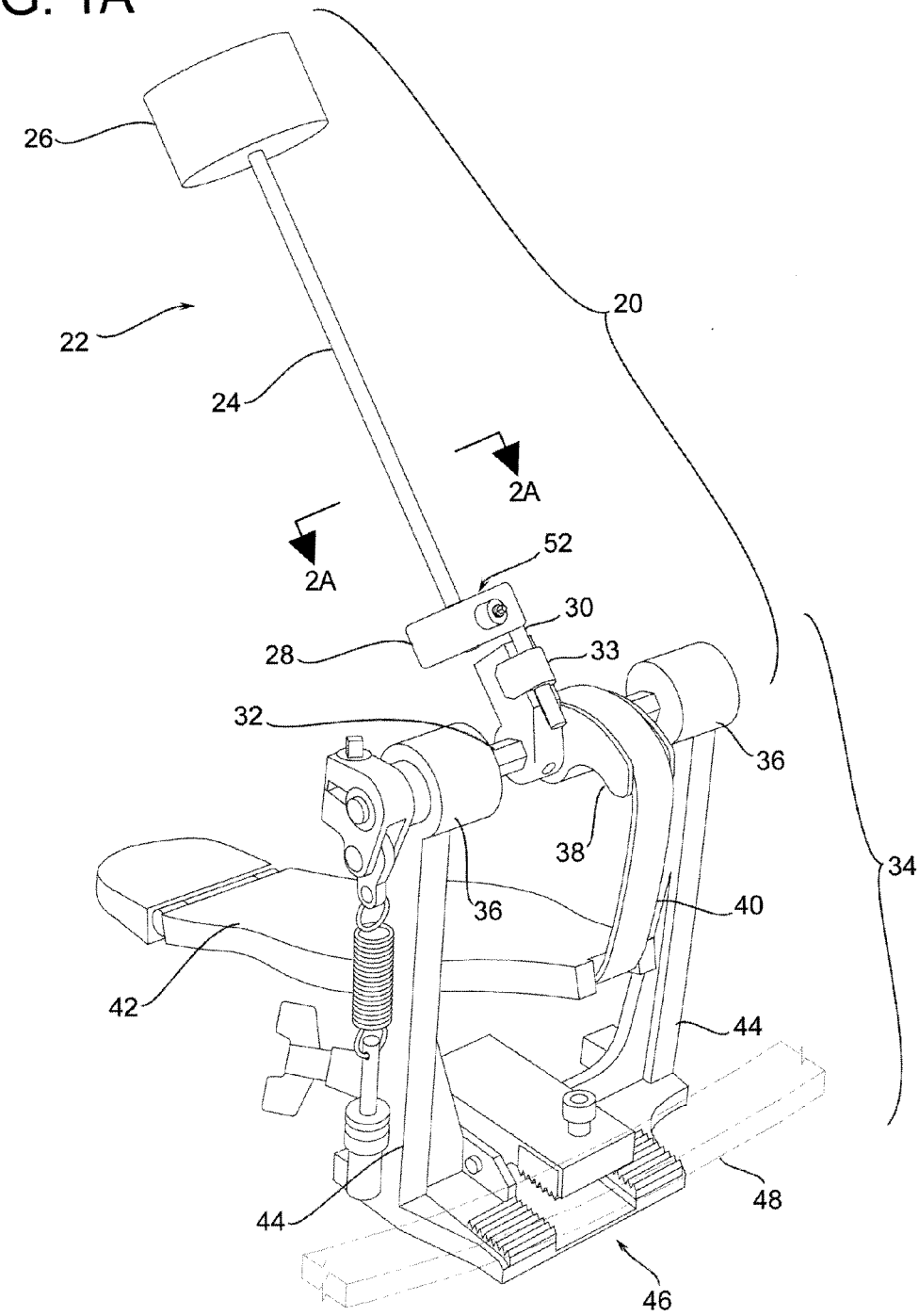
FIG. 1A is an isometric view of one embodiment of the disclosure.

In the field of drums, is it is often desired to have a foot pedal which operates to move a mallet or beater from a position away from the drum head to a position whereupon the mallet head impacts the face of the drum. This is often accomplished by exerting one's foot against the foot pedal, which translates the motion of the foot pedal into a swinging motion of the mallet about a pedal axle. There are many patents and embodiments of such mechanisms, including U.S. Pat. No. 6,392,130. The disclosure of this patent allows a user to adjust the mallet as shown in FIG. 1 about the pedal drive axis to a desired orientation, constrained to a single, vertical plane of adjustability.

Applicant has devised a new system and apparatus which not only allows the user to position the mallet about the pedal drive axis in a rotational manner, but also allows multi-directional, multi-planar adjustment about a second origin through a spherical section. For ease of discussion, the entire assembly as shown in Applicant's FIG. 1 will be broken into two major assemblies. The first assembly is an adjustment assembly 20, which comprises the mallet 22 having a shaft 24 and a head 26. The adjustment assembly 20 further comprises a mallet clamp 28 connected to a post 30 which is received by a post seat 33 which is coupled to the pedal axle 32. The second, or pedal assembly 34 interoperates with the adjustment assembly 20 by way of the pedal axle 32. The pedal assembly 34 further comprises a plurality of axle bearings 36, a cam 38, a connective member 40, and a footplate 42. The entire device is supported by a plurality of pillar supports 44, which often rest on the floor. The pedal assembly 34 may further comprise a drum rim clamp 46 which is configured to clamp upon a drum rim 48 to attach the entire device to the drum rim 48.

Figure 6:
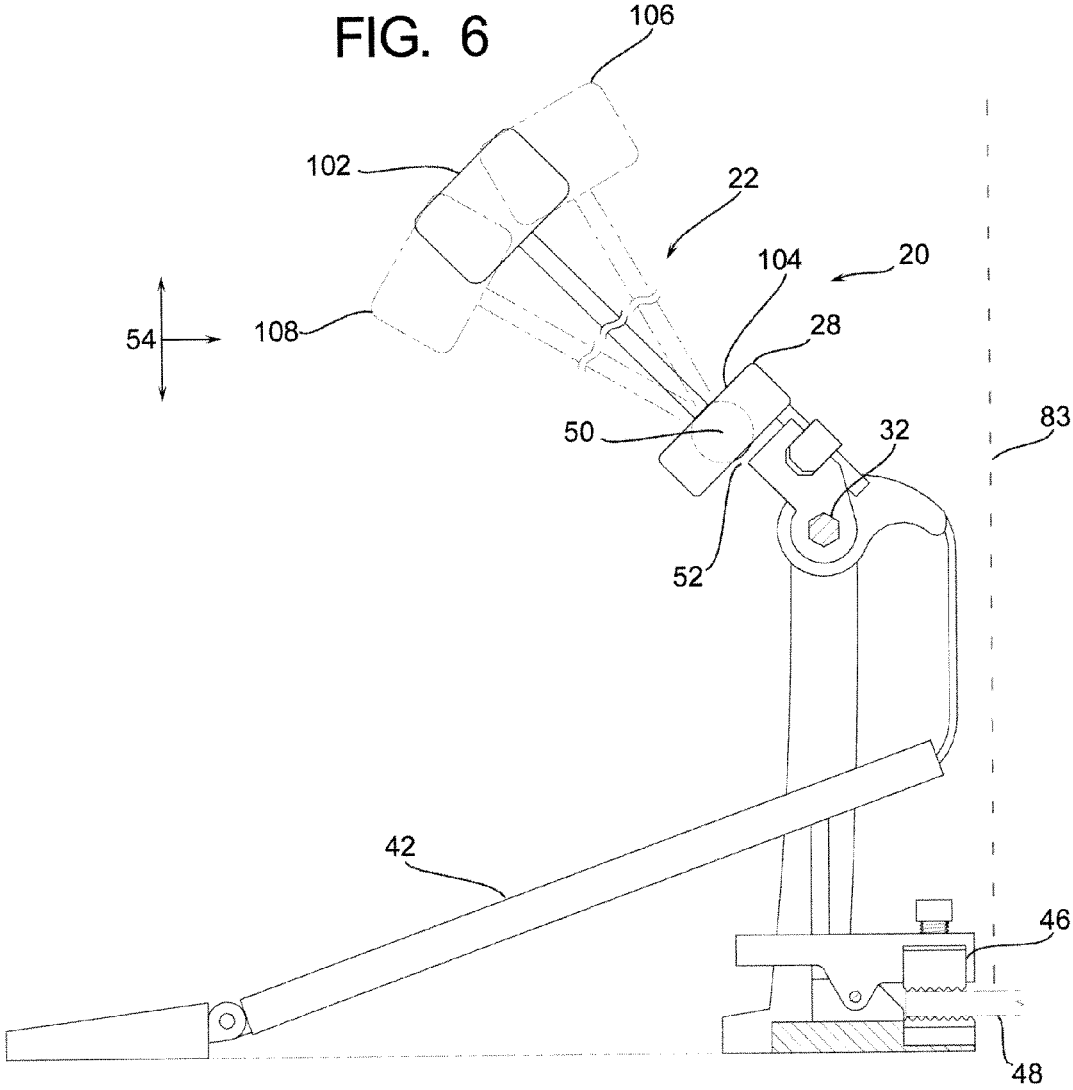
FIG. 6 is a side view of one embodiment of the disclosure showing a footplate in an upper position.

Looking now to FIG. 6, it is seen how using the embodiments disclosed herein allows the user to not only rotate the entire adjustment assembly 20 about the pedal axle 32, but also allows the user to rotate the mallet 22 about a ball joint origin 50. As shown in the side view of FIG. 6, the ball joint 52 allows for positioning of the mallet 22 through a vertical plane but also in a horizontal plane 56 simultaneously. Additionally, as shown in FIG. 3B, the ball 58 of the ball joint 52 may comprise a through hole 60 having an inner diameter substantially the same as the outer diameter of the mallet shaft 24. This allows the mallet shaft 24 to slidably engage the ball 58. The ball 58 may further comprise a split 100 such that when the ball joint socket 62 is tensioned about the ball 58, the through hole 60 compresses about the mallet shaft 24, securing the mallet 22 about the mallet clamp 28, not only in reference to positioning about the origin 50 but also in reference to the distance between the mallet head 26 and the mallet clamp 28.

Several different embodiments are disclosed herein, each referring to the overriding concept of utilizing a ball joint 52 to adjust the angle of a mallet 22 in reference to a pedal axle 32.

Figure 2A:
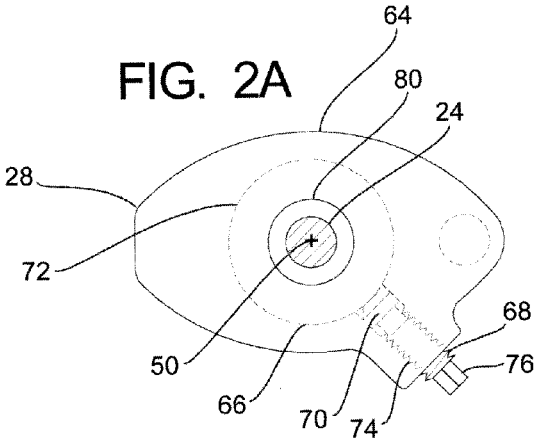
FIG. 2A is a hidden line view of one embodiment of the disclosure from the side.
Figure 3A:
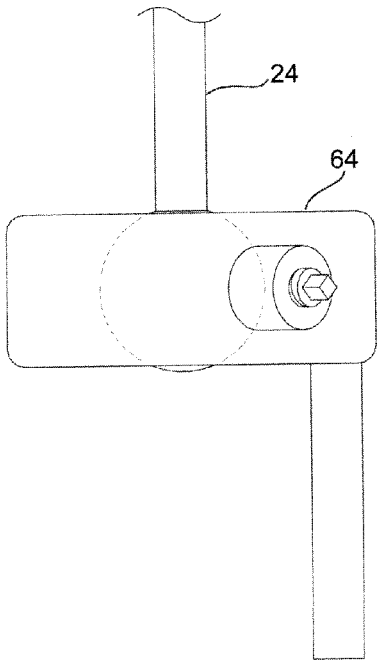
FIG. 3A is a hidden line view of one embodiment of the disclosure as shown in FIG. 2 orthogonal to the view of FIG. 2A.
Figure 3B:
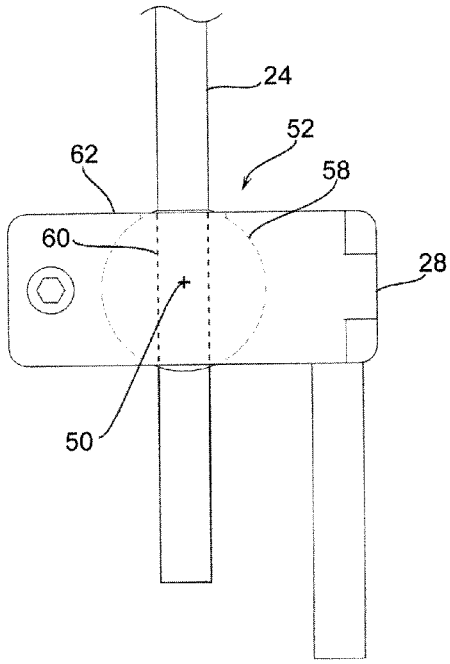
FIG. 3B is a hidden line view of another embodiment of the disclosure as shown in FIG. 2B orthogonal to the view of FIG. 2B.
Figure 4A:
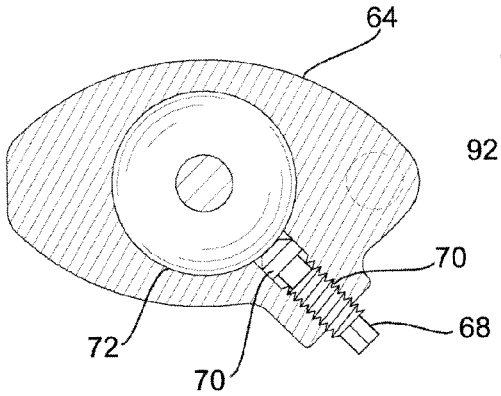
FIG. 4A is a partial cutaway view of one embodiment of the disclosure as shown in FIG. 2A.
Figure 4B:
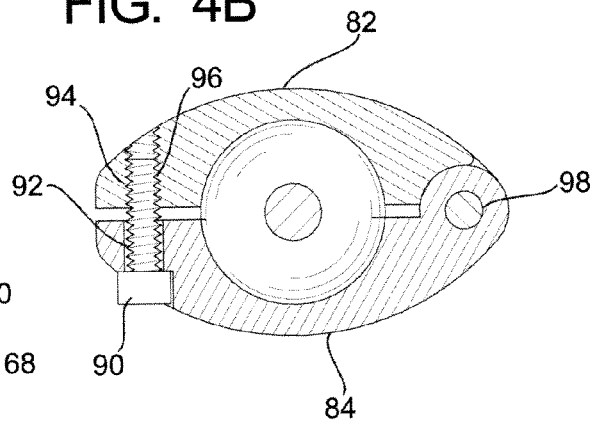
FIG. 4B is a partial cutaway view of another embodiment of the disclosure as shown in FIG. 2B.
Figure 8:
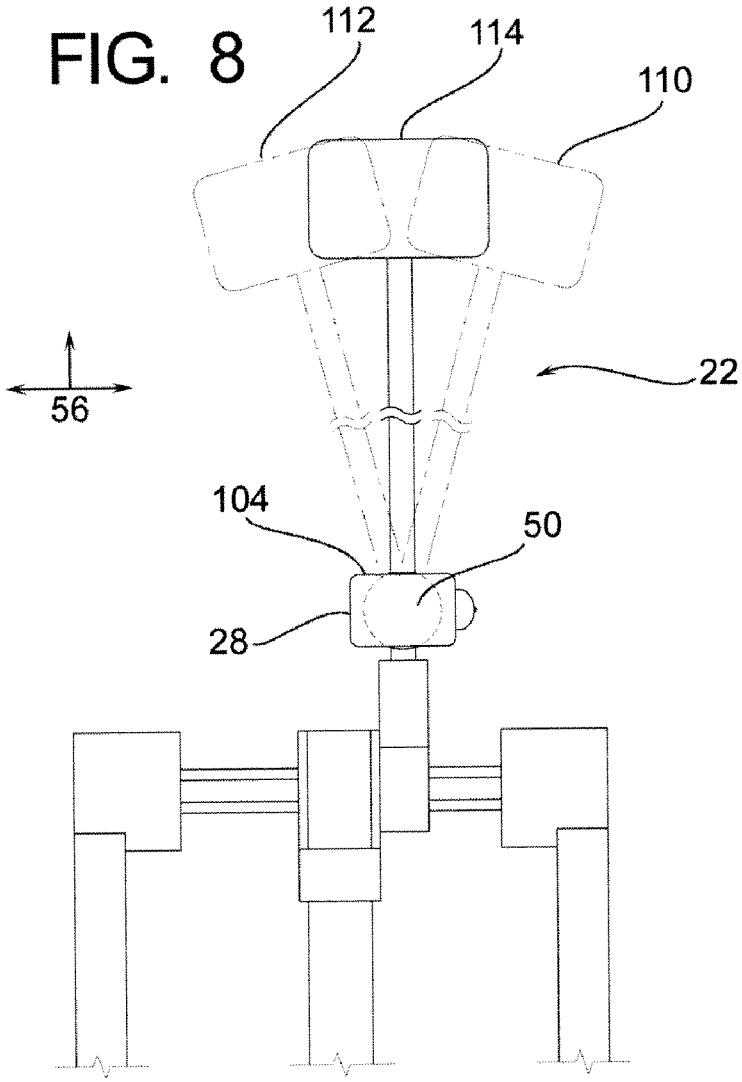
FIG. 8 is an end view of one embodiment of the disclosure showing several position angles of a drum mallet.
Figure 16:
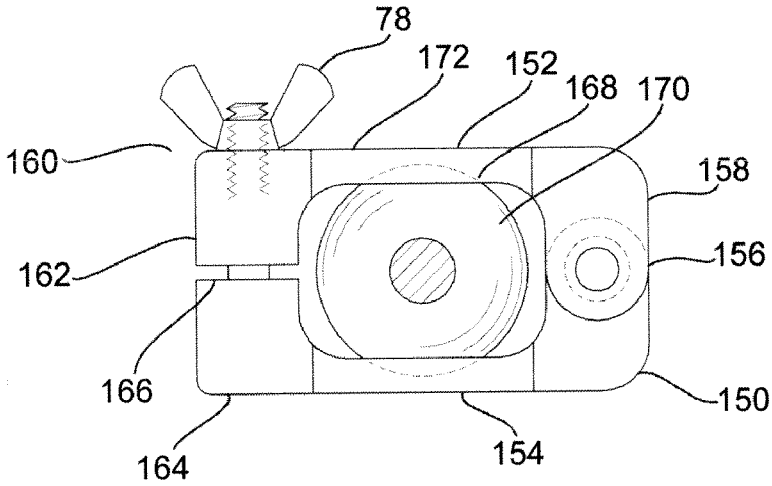
FIG. 16 is a hidden line end view of another embodiment of the disclosure.

The first embodiment to be discussed is most easily understood by looking to FIGS. 2A, 3A, and 4A. In this embodiment, the mallet clamp 28 substantially comprises a clamp body 64 in which a ball joint socket 66 is disposed having a substantially spherical inner surface. This substantially spherical inner surface can be formed as a clamping body 64 is made of a plurality of components which are combined after the ball joint ball 58 is inserted thereto, as it may be difficult to manufacture the ball joint ball 58 within the clamping body 64 as a unitary structure using standard methods. When it is desired to reposition the mallet shaft 22 about the origin 50, a set screw 68 or equivalent device is released from a tensioned state. In the tensioned state, the portion 70 of the set screw 68 is in contact with and exerting pressure upon the outer surface 72 of the ball joint ball 58. This contact portion 70 may be comprised of a separate material from the set screw 68, such as a polymer or plastic material, which would thus tend not to mar the outer surface of the ball joint ball 58 when tensioned. To accomplish a tensioned state, the set screw 68 is threaded, to match the set of threads 74 within the clamp body 64. It may be desired to utilize a key screw 76. These key screws 76 are well-known in the art of drums and are twisted by way of a drum key, which is not shown. Of course, standard screws or bolts can also be used, as could a wing bolt similar to the wing bolt 78 as shown in FIG. 16. The clamp body 64 comprises an opening 80 through which the mallet shaft 24 extends. When the set screw 68 is released, the mallet shaft 24 can reposition about the origin 50 as shown in FIGS. 6 and 8, in a vertical plane 54 and in a horizontal plane 56. This allows a user to position the mallet 22 as desired relative to the drum face 83 such that the mallet head 26 contacts the drum face 83 as desired.

Figure 5:
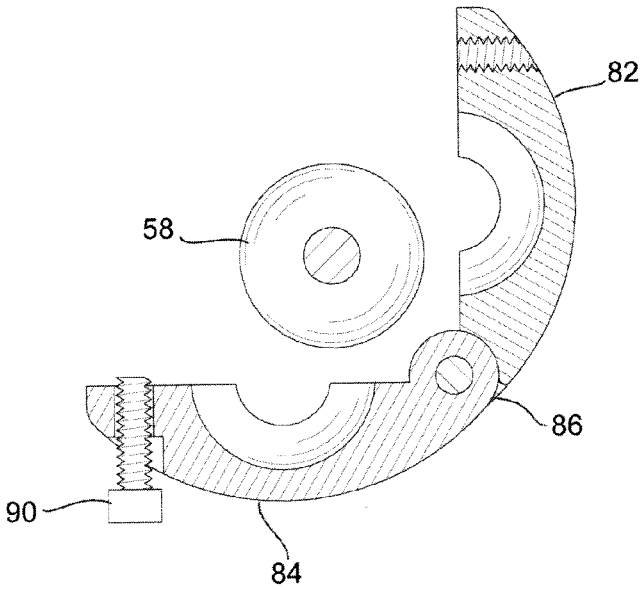
FIG. 5 is a partial cutaway view of one embodiment of the disclosure as shown in FIG. 4B in an open orientation.

A second embodiment to be discussed is most easily shown in FIGS. 2B, 3B, 4B, and 5. In this embodiment, the clamping body 80 comprises a first clamping portion 82 and a second clamping portion 84, and the first and second clamping portions are hingedly and positionably coupled at a hinge 86. The hinge 86 may comprise a pivot including a pivot pin, or may comprise a flexible structure or material which allows the clamping body to flex and tighten around the ball joint ball 58. As previously shown, the clamping body 80 comprises a ball joint socket 88 which has a substantially spherical inner diameter of substantially the same diameter as the outer diameter as the ball joint ball 58, which is coupled to the mallet shaft 24. To tension the ball joint socket 88 against the ball joint ball 58, a tensioned member 90 is provided, such as a screw, bolt, wing bolt, or similar device. A quick locking device such as a cam lock could also be used. Cam locks are often found in the tensioning members of bicycle axles, to quickly and easily remove the bicycle wheels from the frame. In a different embodiment, utilizing a threaded tensioning member 90, the void 92 in the second clamping portion may not be threaded. In this embodiment, the void 94 of the first clamping portion 82 may comprise engaging threads 96. In one form, a post 98 forms a portion of the hinge 86 wherein the post 98 provides the same functionality as the supporting post 30 which extends between the mallet clamp 28 and a post-seat 33 as shown in FIG. 1. As previously described and as shown in FIG. 3B, the ball 58 may comprise a through hole 60, through which the mallet shaft 24 slid ably engages. As previously discussed, this allows for the distance between the mallet head 26 and the mallet clamp 28 to be adjusted. Once the tensioning member 90 is utilized to exert tension between the ball joint socket 88 and the ball joint 58, the split 100 in the ball joint ball 58 closes and exerts tensile force between the outer surface of the mallet shaft 24 and the through hole 60 as prohibiting further movement of the mallet shaft 24 through the through hole 60 and operatively fixing the relative positions thereof. FIG. 5 shows this embodiment in an open configuration where any tensioning member 90 has been completely released such that the first clamping portion 82 and second clamping portion 84 have pivoted about the hinge 86 to allow release of the ball joint ball 58 for replacement, storage, or any other desired movement.

Figure 7:
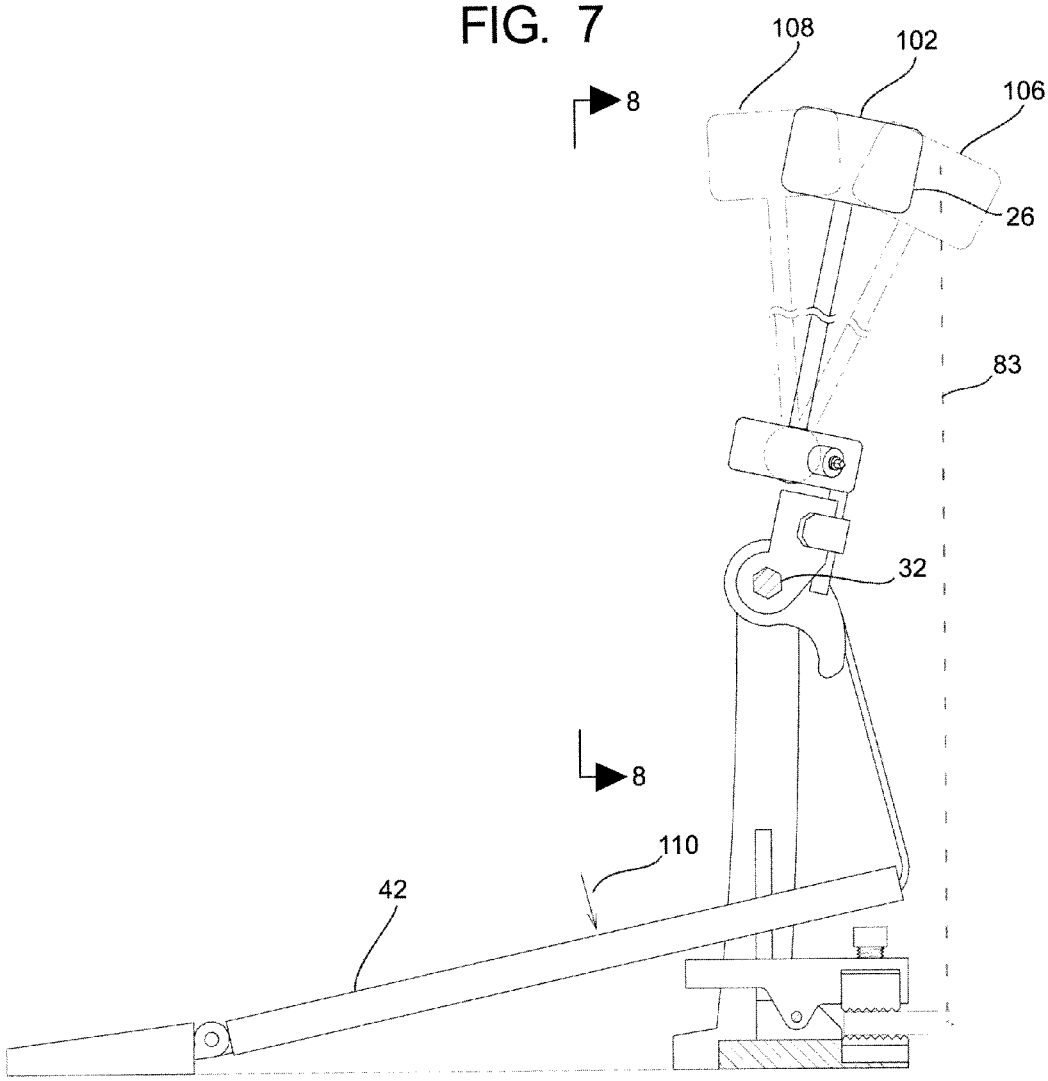
FIG. 7 is a side view of one embodiment of the disclosure showing a footplate in a lower position.

Looking now to FIG. 6, which is a side view of the device, the vertical plane 54 which has already been briefly discussed is shown. While the term vertical plane is utilized, the vertical plane 54 is generally defined as being substantially vertical to the floor and substantially parallel to the long axis of the footplate 42. The adjustment assembly 20 allows the mallet 22 to rotate about the origin 50 through this vertical plane 54 as shown. FIG. 6 shows the mallet 22 in three positions about the origin 50. The first position 102 shows the mallet 22 extending substantially perpendicular to the outward face 104 of the mallet clamp 28. The ghost line 106 shows the mallet 22 repositioned forward of the first position 102, and the ghost line 108 shows the mallet 22 repositioned downward of the first position 12 in the vertical plane 54. Each of these positions are relative to the mallet clamp 28, and when the footplate 42 is repositioned downward by sufficient force in the downward direction 110 as shown in FIG. 7, the adjustment assembly 20 rotates about the pedal axle 32 and impacts the drum face 83. Thus it can be seen how adjusting the position of the mallet 22 as shown in FIG. 6 results in different impact positions when the footplate 42 is depressed as shown in FIG. 7. As shown, the forward position 106 would indicate that the mallet head 26 has gone into the drum face 83. Obviously this is not normally possible, and is simply utilized to indicate that the footplate 42 need travel a much shorter distance when the mallet 22 is in the forward position 106.

Figure 9:
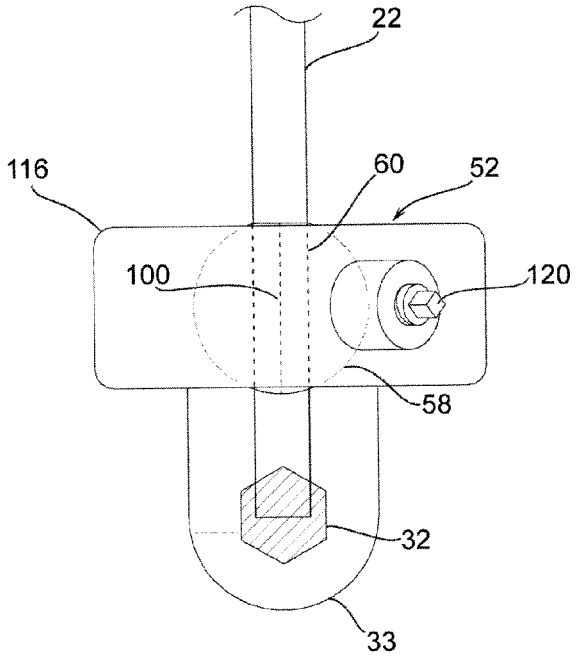
FIG. 9 is a side hidden line view of one embodiment of the disclosure.
Figure 10:
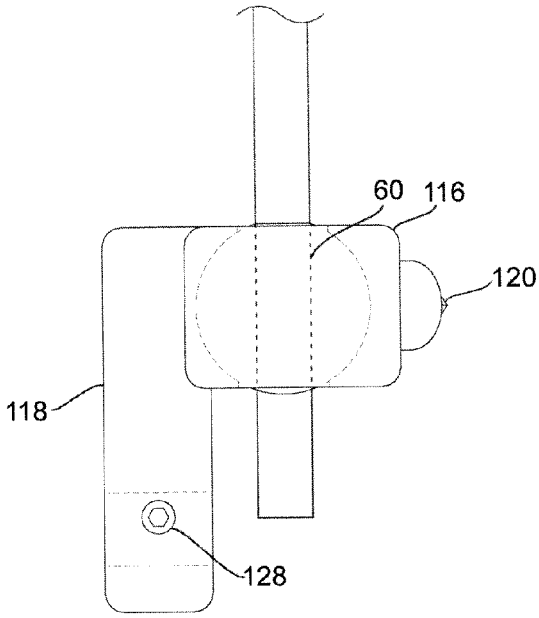
FIG. 10 is a top hidden line view of one embodiment of the disclosure as shown in FIG. 9.
Figure 11:
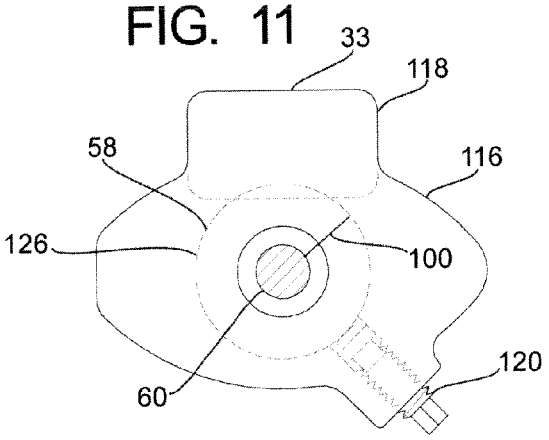
FIG. 11 is an hidden line view of one embodiment of the disclosure as shown in FIG. 9.
Figure 12:
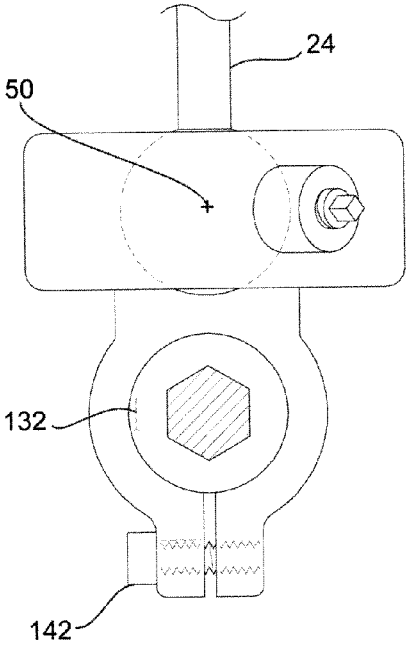
FIG. 12 is a side hidden line view of one embodiment of the disclosure.
Figure 13:
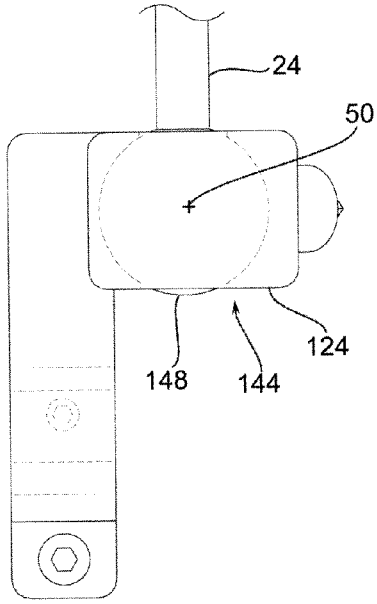
FIG. 13 is a top hidden line view of one embodiment of the disclosure as shown in FIG. 12.
Figure 14:
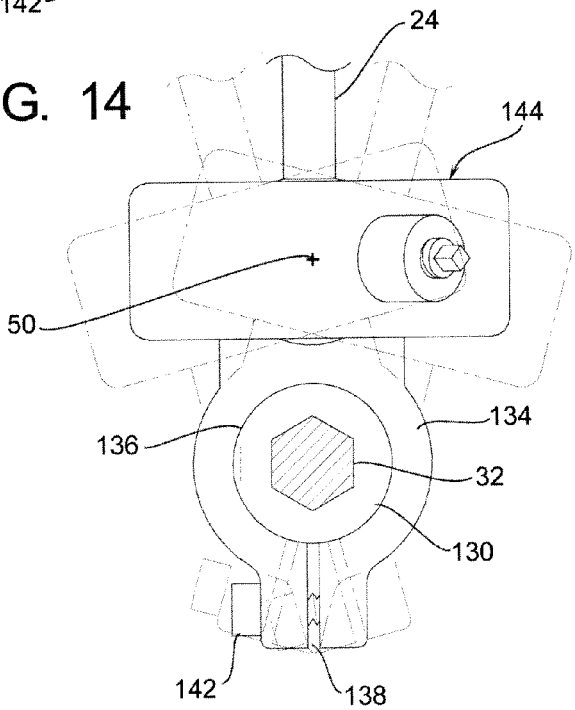
FIG. 14 is a side hidden line view of one embodiment of the disclosure as shown in FIG. 12 showing several angles of adjustment of the device.
Figure 15:
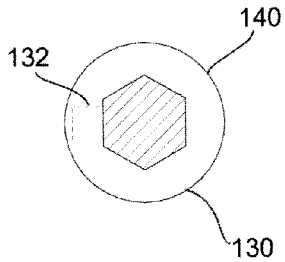
FIG. 15 is a side view of a detail portion of FIG. 14.

Looking to FIG. 8, the orthogonal plane 56 is generally defined as being perpendicular to the vertical plane 54. Once again, repositioning of the mallet 22 with respect to the origin 50 through the orthogonal plane 56 can be accomplished in the matter previously discussed. Thus the mallet 22 can be adjusted in a right position 110 or a left position 112, wherein a central position 114 generally refers to a position perpendicular to the outward face 104 of the mallet clamp 28. This adjustment can also be utilized In the previous embodiments, the mallet clamp 28 was shown coupled to the pedal axle 32 through a post 30 and post seat 33. This allows for additional angles (axis) of adjustability rotationally about the post 30 and longitudinally along the long axis of the post 30. Looking now to FIGS. 9 through 11, an embodiment is shown wherein the mallet clamp 116 is directly coupled to the pedal axle 32. Once again, the ball joint ball 58 may comprise a through hole 60, which in conjunction with a split 100 allows the mallet 22 to be slidably positioned in reference to the ball joint 52. The mallet clamp 116 as shown in FIG. 10 generally comprises a clamping body 118 which frictionally engages the ball joint ball 58 by way of a tensioning member 120. 11. The operation of this apparatus follows the operation of the embodiment shown in FIG. 2B utilizing a tensioning member 124 to exert tension between the ball joint socket 126 and the ball joint ball 58. In one form, the pedal axle 32 has a polyhedron cross-section, such as a hexagon as shown, although other cross-sections could also be utilized, including a cylindrical shaft. A set screw 128 is thread into the clamping body 118 and tightened to exert pressure against a portion of the outer surface of the pedal axle 32 to maintain the relative position of these two components.

In another embodiment as shown in FIGS. 12 through 15, a collar 130 engages the pedal axle 32 and is fixed in place by a set screw 132. A split collar ring 134 has an inner diameter 136 which matches the outer diameter 140 of the collar 130 and may be frictionally engaged thereto. A split 138 allows the collar ring 134 to be positioned around the collar 130, at which point the collar ring 134 may be rotationally positioned about the collar 130 and fixed in place by tensioning a tensioning member 142 which causes the collar ring 134 to tighten about the collar 130 and thus fix it in place. As shown, this allows the ball joint 144 and the attached mallet shaft 24 a greater degree of adjustability about the pedal axle 32. As previously shown, a ball joint 144 comprises a socket 146 which frictionally engages a ball 148 coupled to the mallet shaft 24. This allows the previously described spherical positioning of the mallet shaft 24.

By providing a mechanism for adjusting the position of the beater shaft 24 relative to the pedal axle 32, the amplitude of the entire device may be adjusted. If the beater or mallet head 26 is pre-set very close to the drum face, then a small motion of the user's foot will result in the mallet head 26, impacting the drum face. Alternatively, if the mallet head 26 is pre-set a further distance from the drum face, then the user's foot may need to move further for the mallet head 26 to impact the drum face 83, but it may be possible to accelerate the mallet head to a much higher speed, thus impacting the drum face 83 with additional force.

Figure 2B:
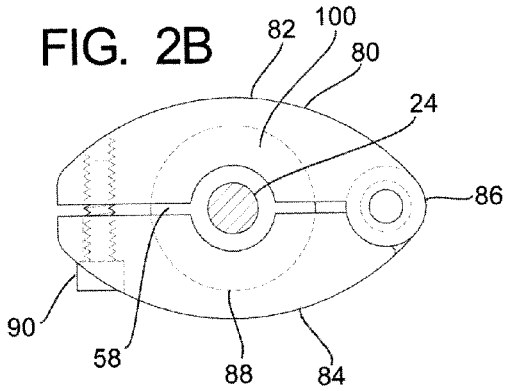
FIG. 2B is a hidden line view of another embodiment of the disclosure from the side.
Figure 17:
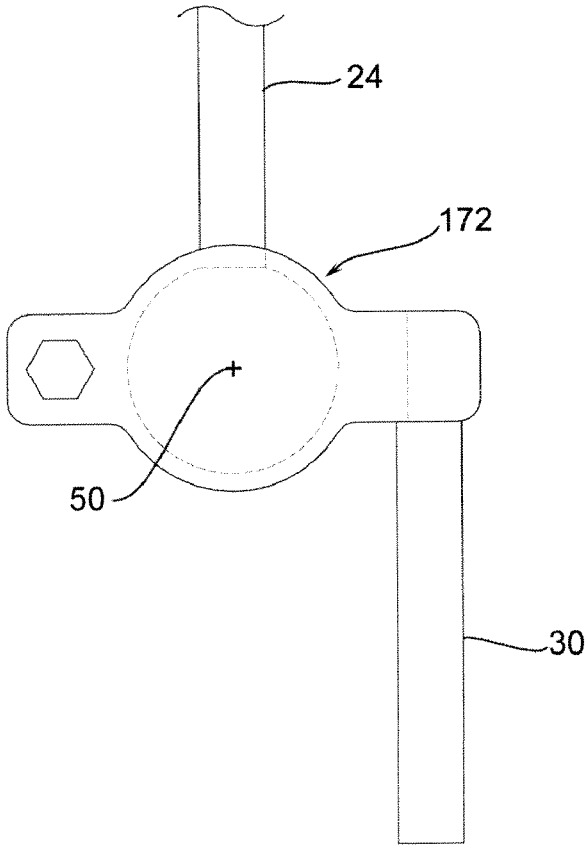
FIG. 17 is a hidden line view of a ball and socket joint, in one form.

The embodiment shown in FIGS. 16 and 17 is similar to the embodiments shown in FIGS. 2B and 3B. Looking to FIG. 16, it can be seen how the mallet clamp 150 comprises a first clamping portion 152 and a second clamping portion 154. The clamp hinge 156 serves to couple the first clamping portion 152 to the second clamping portion 154 on a hinge side 158. A pressure mechanism 160 serves to couple the first clamping portion 152 to the second clamping portion 154 at a split side 162. In one form, the pressure mechanism 160 comprises a fastener or bolt 164 and a wing nut 78 as previously discussed. A gap 166 between the first clamping portion 152 and second clamping portion 154 allows the mallet clamp 150 to compress the socket 168 against the ball 170 when the pressure mechanism 160 is in a tension state. In this way, the ball joint 172 can be released to allow spherical positioning of the mallet shaft 24 about the origin or center 50 of the ball-and-socket joint 172. In one form, the mallet clamp 150 is coupled to the pedal axle 32 through a post 30, post seat 33 as previously discussed.

Figure 18:
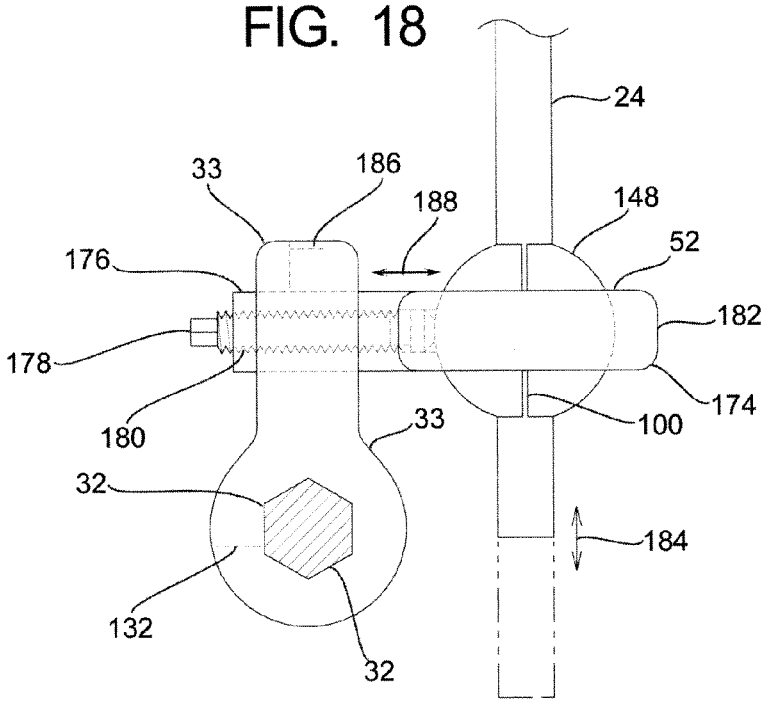
FIG. 18 is a hidden line side view of a ball and socket joint attached to a post seat, in one form.
Figure 19:
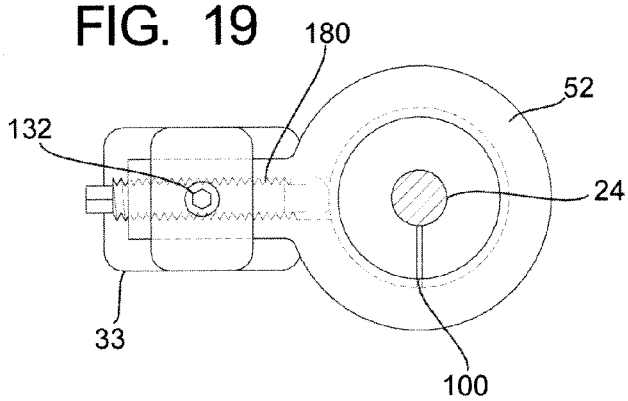
FIG. 19 is a hidden line plan view of a ball and socket joint attached to a post seat, in one form.
Figure 20:
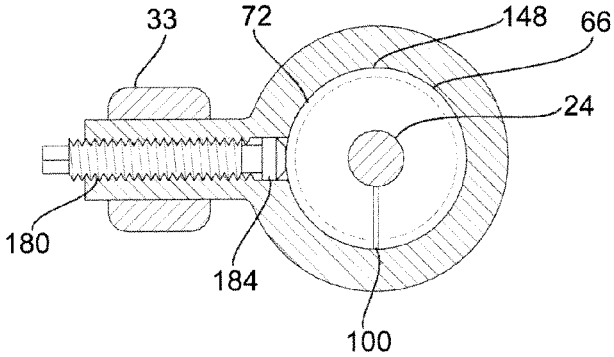
FIG. 20 is a cutaway line side view of a ball and socket joint attached to a post seat as shown in FIG. 19, in one form.

Yet another embodiment is shown in FIGS. 18 through 20 wherein the clamping body 174 and shaft 176 are comprised of a unitary structure. In this way, the shaft 176 directly engages the post seat 33 as previously discussed. To adjust the clamping pressure of the clamping body 174, a set screw 178 is provided which may engage the shaft 176 by way of a plurality of threads or a threaded portion 180. In one form, the threaded portion 180 extends through the longitudinal axis of the shaft 176. Also as previously discussed, the set screw or tensioning member 178 may not only adjust the clamping pressure exerted between the ball joint socket 182 and the ball 148, but may also serve to exert pressure between the ball 148 and the mallet shaft 24 to allow adjustability along a longitudinal axis 184 as previously discussed. To accomplish this, a contact member 184 such as a portion of a malleable substance may be disposed between the set screw 178 and the outer surface 72 of the ball 148. This embodiment also allows for rotational adjustability around the shaft 176 when the tensioning member 186 is released. The tensioning member 186 extends through an upper portion of the post seat 33. Furthermore, it is conceived that transverse motion or adjustability would be allowed by this embodiment along a transverse axis 188. Wherein the shaft 176 is not cylindrical, a finite number of adjustments could be made equivalent to a number of sides of the shaft 176.

Figure 1B:
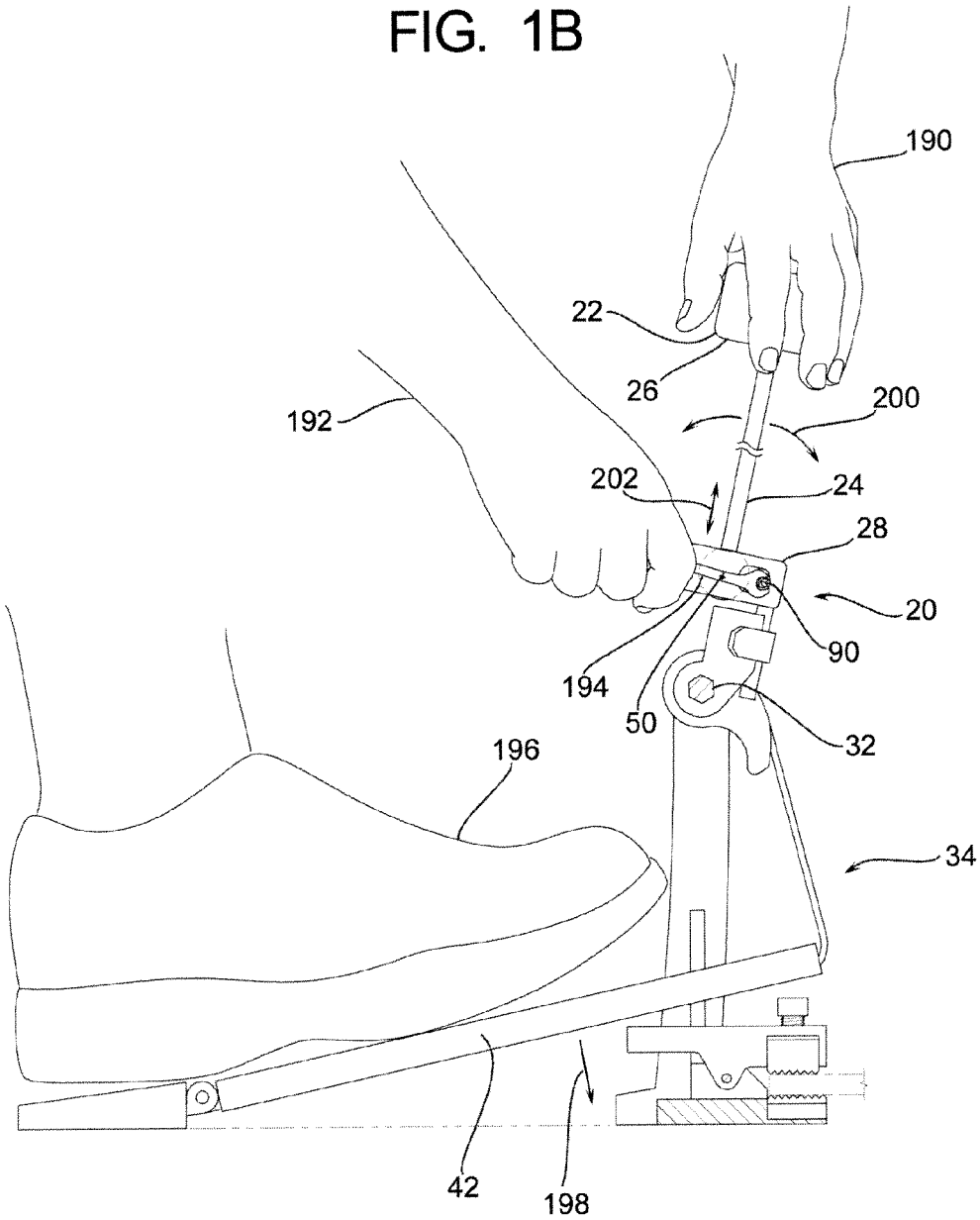
FIG. 1B is a side view of one embodiment of the disclosure in the process of being adjusted by a user.

Looking to FIG. 1B, the adjustment assembly 20 is shown being adjusted by a user, wherein the user has grasped the mallet 22 with his first hand 190 and is releasing the tensioning member 90 with his second hand 192. In this embodiment, the user is utilizing a tool 194 to release the tensioning member 90; however, as previously discussed, it may be alternately possible to activate the tensioning member 90 without the use of a tool 194. In one form, it may be desired that the user press down upon the footplate 42 with their foot 196 in a downward direction 198 prior to adjusting the adjustment assembly 20. In this way, the adjustment assembly 20 can be set wherein the mallet 22 is in contact with the drum face 83 previously shown and discussed.

Once the tensioning member 90 is released, the mallet 22 can be positioned around a spherical axis 200 centering upon the origin 50 of the ball joint as previously discussed. Additionally, in one form the mallet 22 may be repositioned linearly 202 through the mallet clamp 28 to adjust the effective length of the mallet shaft 24 between the mallet clamp 28 and the mallet head 26.

After the assembly is in the desired orientation, the tensioning member 90 is tensioned, and thus pressure is exerted upon the ball of the ball joint to fix the position of the mallet 22 relative to the mallet clamp 28. At which point, the footplate 42 is released, and the adjustment assembly 20 and pedal assembly 34 are ready for operation.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A ball joint adjustment assembly for a drum mallet, the assembly comprising:

a. a bass drum pedal axle operatively configured to rotate about a pedal drive axis;

b. a substantially spherical ball joint socket coupled to the bass drum pedal axle and operatively configured to rotate therewith;

c. wherein the ball joint socket comprises a hinge side and a split side;

d. a pressure mechanism coupled to the ball joint socket and operatively configured to adjust an inner diameter of the ball joint socket;

e. a ball joint ball having an outer spherical diameter substantially the same as the inner diameter of each side of the ball joint socket;

f. a drum mallet coupled to the ball joint ball and extending therefrom; and g. wherein the angle of the drum mallet can be adjusted about the center of the ball joint while the pressure mechanism is in the released state and is furthermore substantially affixed in place when the pressure mechanism is in a tensioned state.

2. The mallet adjustment assembly as recited in claim 1;

a. wherein the drum mallet comprises a mallet shaft which passes through the ball joint ball; and b. wherein the mallet shaft slidably engages the ball joint ball while the pressure mechanism is in the released state; and c. wherein the mallet shaft is substantially fixedly coupled to the ball joint ball when the pressure mechanism is in the tensioned state.

3. The mallet adjustment assembly as recited in claim 1 wherein the pressure mechanism is a wing nut.

4. The mallet adjustment assembly as recited in claim 1 wherein the hinge side of the ball joint socket further comprises a pivot.

5. The mallet adjustment assembly as recited in claim 1 further comprising a post extending between the bass drum pedal axle and the ball joint socket.

6. The mallet adjustment assembly as recited in claim 1 wherein the bass drum pedal axle is coupled to a bass drum pedal operatively configured such that sufficient pressure upon the footplate will cause the bass drum pedal axle to rotate.

7. The mallet adjustment assembly as recited in claim 1 further comprising:

a. a collar operatively configured to engage the outer surface of the drum pedal axle;

b. a collar ring operatively configured to engage the outer surface of the collar and be selectively and rotatably positioned therewith;

c. wherein the collar ring comprises a tensioning member which is operatively configured to fix the position of the collar ring relative to the collar; and d. wherein the collar ring is coupled to the ball joint socket.

8. A method for adjusting a drum mallet coupled to a footplate, the method comprising the steps of:

a. grasping the mallet with a first hand and grasping a pressure mechanism with a second hand;

b. releasing the pressure mechanism such that the mallet is free to rotate about the center of a ball joint socket mechanically coupled to the footplate;

c. rotating the mallet about the center of the ball joint socket to the desired orientation; and d. tensioning the pressure mechanism to hold the mallet in place in reference to the ball joint socket.

9. The method for adjusting the drum mallet as recited in claim 8 further comprising the step of sliding a mallet shaft through the ball joint ball to adjust the distance between the mallet head and the ball joint to the desired distance.

10. The method for adjusting the drum mallet as recited in claim 8 wherein the step of releasing the pressure mechanism involves a single movement of a single fastener.

11. The method as recited in claim 8 further comprising a step of adjusting a collar ring assembly operatively configured to engage an outer surface of a collar operating as the pressure mechanism, wherein the collar ring is a separate mechanism from the ball joint socket.

12. The method as recited in claim 8 wherein the ball joint socket allows adjustment of the mallet in multiple planes about the origin of the ball joint socket.

13. A ball joint adjustment assembly for a drum mallet comprising:

a. a bass drum pedal axle operatively configured to rotate about a pedal drive axis;

b. a ball joint socket comprising a first clamping portion and a second clamping portion;

c. wherein the first clamping portion is rigidly attached to the second clamping portion at a clamping hinge;

d. a pressure mechanism operatively configured to adjust the inner diameter of the ball joint socket;

e. a ball joint ball comprising an outer diameter substantially the same as the inner diameter of the ball joint socket when the pressure mechanism is in the released state;

f. a mallet comprising a mallet shaft coupled to the ball joint.

14. The mallet adjustment assembly as recited in claim 13 wherein the ball joint ball comprises a through hole having an inner diameter substantially the same as the outer diameter of the mallet shaft when the pressure mechanism is in the released state and wherein the through hole is operatively configured to be adjusted such that the inner diameter of the through hole is adjustable to impart frictional resistance against the outer diameter of the mallet shaft when the pressure mechanism is in the tensioned state.

15. The mallet adjustment assembly as recited in claim 13 further comprising:

a. a collar operatively configured to engage the outer surface of the drum pedal axle;

b. a collar ring operatively configured to engage the outer surface of the collar and be selectively and rotatably positioned therewith, c. wherein the collar ring comprises a tensioning member which is operatively configured to fix the position of the collar ring relative to the collar; and d. wherein the collar ring is coupled to the ball joint socket.

16. An adjustment assembly for a drum mallet comprising:

a. a bass drum pedal axle operatively configured to rotate about a pedal drive axis;

b. a ball joint socket coupled to the bass drum pedal axle and operatively configured to rotate therewith;

c. a ball joint having an outer spherical diameter substantially the same as the inner diameter of the ball joint socket;

d. a set screw operatively configured to engage the outer surface of the ball joint to adjust the force required to reposition the ball joint in reference to the ball joint socket;

e. a drum mallet coupled to the ball joint and extending therefrom;

f. wherein the angle of the drum mallet can be adjusted about the center of the ball joint while the pressure mechanism is in the released state and is furthermore affixed in place when the pressure mechanism is in the tensioned state.

17. The adjustment assembly as recited in claim 16 wherein the drum mallet comprises a mallet shaft which passes through the ball joint ball, wherein the mallet shaft slidably engages the ball joint.

18. The adjustment assembly as recited in claim 16 further comprising a post extending between the base drum pedal axle and the ball joint socket.

19. The adjustment assembly as recited in claim 16 wherein the set screw threadedly engages the ball joint socket.

20. The mallet adjustment assembly as recited in claim 16 further comprising:

a. a collar operatively configured to engage the outer surface of the drum pedal axle;

b. a collar ring operatively configured to engage the outer surface of the collar and be selectively and rotatably positioned therewith, c. wherein the collar ring comprises a tensioning member which is operatively configured to fix the position of the collar ring relative to the collar; and d. wherein the collar ring is coupled to the ball joint socket.

* * * * *